United States Patent [19]

Rodriguez

[11] Patent Number: 4,856,386

[45] Date of Patent: Aug. 15, 1989

[54] SOCKET ASSEMBLY FOR MULTIPLE SIZE WRENCHING SURFACES

[76] Inventor: Hector L. Rodriguez, 40 Porter St., New Haven, Conn. 06511

[21] Appl. No.: 248,596

[22] Filed: Sep. 26, 1988

[51] Int. Cl.[4] ..... B25B 13/32

[52] U.S. Cl. ..... 81/90.2; 81/53.2

[58] Field of Search ..... 81/90.1, 90.2, 53.2

[56] References Cited

U.S. PATENT DOCUMENTS 2,592,037 4/1952 Keiser ..... 81/90.2 X
3,413,876 12/1968 Shinn ..... 81/53.2
4,676,125 6/1987 Ardelean ..... 81/90.2 X
4,724,730 2/1988 Mader et al. ..... 81/90.2 X

FOREIGN PATENT DOCUMENTS 1042984 9/1983 U.S.S.R. ..... 81/90.2

*Primary Examiner*—James G. Smith
*Attorney, Agent, or Firm*—Richard A. Craig

[57] ABSTRACT

A socket assembly adapts automatically to wrenching surfaces of a nut or a bolt within a predetermined range of sizes. The socket assembly includes interfitting and relatively rotatable outer and inner annular members and a plurality of spring-loaded pawls for gripping the wrenching surfaces of the nut or the bolt to impart wrenching torque thereto.

3 Claims, 2 Drawing Sheets

SOCKET ASSEMBLY FOR MULTIPLE SIZE WRENCHING SURFACES

BACKGROUND OF THE INVENTION

This invention relates to wrenching devices and more particularly to a socket assembly which can accommodate a range of wrenching surface sizes so as to reduce the number of sockets necessary to handle a total range of wrenching surface sizes.

Turner U.S. Pat. No. 1,033,358 which issued July 23, 1912 utilizes different sets of sectional head members which may be placed in different slots of a wrench to operate on different size nuts. The wrenching head members are readily interchanged with other items, such as taps.

Sayre U.S. Pat. No. 1,058,795 which issued Apr. 15, 1913 presents a ratchet-wrench with a removable member adapted to be associated with the head of the wrench whereby the wrench may be applied to nuts of various sizes.

Pearson U.S. Pat. No. 1,997,948 which issued Apr. 16, 1935 teaches a socket wrench which automatically adapts itself to nuts and bolt heads of different sizes. This is accomplished by means of spring loaded nested sockets of different sizes.

Hurst et al. U.S. Pat. No. 4,528,875 which issued July 16, 1985 discloses an adjustable socket having telescoping wrenching shims. A lever controls the number of shims which are permitted to move.

Tien U.S. Pat. No. 4,646,594 which issued Mar. 3, 1987 teaches a wrench socket for square and hexagonal wrenching surfaces. The socket is closed and is defined by eight right angled notches for reception of a driving head. The notches have a square opening of four notches equally spaced and sized to engage the square nut or bolt, and a hexagonal opening of six notches for engagement with a hexagonal wrenching surface.

Kelly et al. U.S. Pat. No. 4,699,029 which issued Oct. 13, 1987 discloses a wrench socket having an end to receive a driving wrench in an internal drive opening, a driving end for engaging a threaded fastener to transmit a driving torque and an intermediate external surface area which can be engaged by a second driving wrench. A removable retainer assures that the second wrench is held on the socket, and a series of sockets may be provided which have various sized driving ends.

The present invention distinguishes over the prior patents mentioned above.

It is an important object of the present invention to provide a socket assembly which automatically accommodates itself in use to wrenching surfaces of a plurality of sizes.

It is another important object of the invention to provide a set of such socket assemblies of varying sizes such that the number of sockets needed to handle a total range of wrenching surface sizes is reduced with respect to the prior art.

It is a further object of the invention to provide such a socket which can be used on either hexagonal or square wrenching surfaces.

It is yet another object of the invention to provide such a socket which can be used on wrenching surfaces dimensioned in any system such as Metric or English.

It is a still further important object of the invention to provide such a socket assembly which is of economical construction.

It is still another object of the invention to provide such a socket assembly which is reliable in operation.

The above and other objects and advantages will become evident hereinafter.

SUMMARY OF THE INVENTION

A socket assembly embodying the invention adapts automatically to wrenching surfaces of a nut or a bolt within a predetermined range of sizes. The members of a set of such socket assemblies are of different sizes for imparting wrenching torque to wrenching surfaces having dimensions within a plurality of size ranges.

More specifically, a preferred socket assembly embodying the invention comprises an outer annular member adapted for releasable engagement by a wrench and having an internal annular wall having a pair of like cylindrical portions defining an axis of the assembly and a pair of identical diametrically opposite inwardly extending lobed cam surfaces joining the cylindrical portions.

The socket assembly also comprises an inner annular member within the wall of the outer annular member and having a pair of diametrically opposite slots open at one end of the inner member, first and second identical pawls each having an inner face with a jaw portion and an outwardly bulged lobed portion opposite the inner face. The pawls are mounted with the inner faces confronting each other and the bulged lobed portions extending outwardly through the slots in the inner member. Means in the form of wire springs urge the bulged lobed portions outwardly against the lobed cam surfaces, so that with the wrenching surfaces of the nut or bolt within the inner member, relative rotation of the members in one direction will cause the cam surfaces to push the jaw portions inwardly against the wrenching surfaces and the outer and inner members will thereupon rotate together as a unit to apply wrenching torque to the wrenching surfaces.

DESCRIPTION OF THE INVENTION

Figure 1:
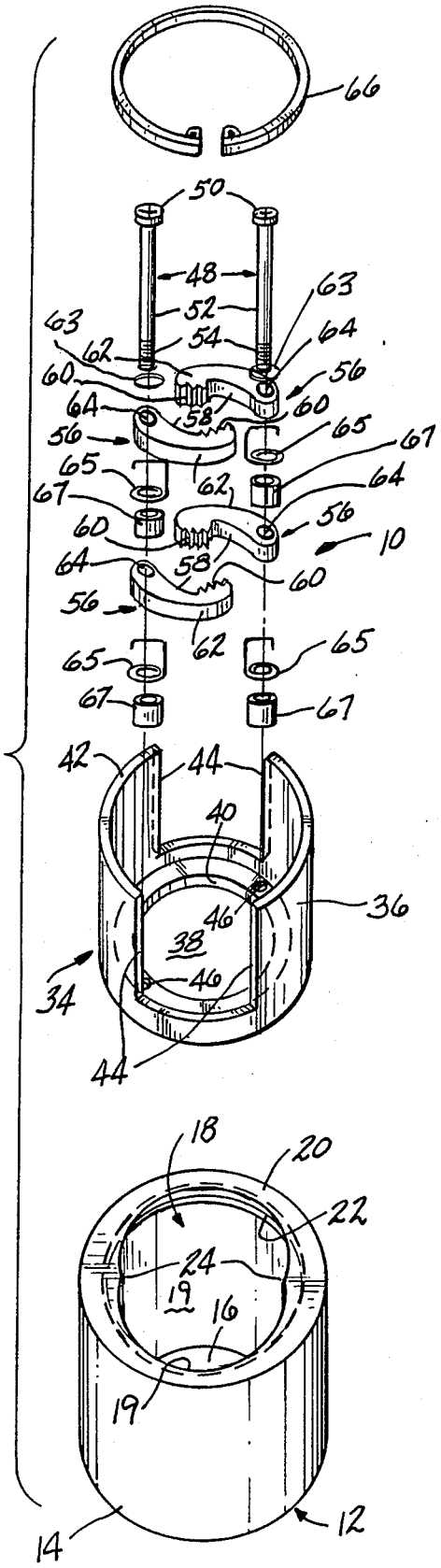
FIG. 1 is a longitudinally exploded perspective view of the unassembled elements of a preferred socket assembly according to the invention.
Figure 2:
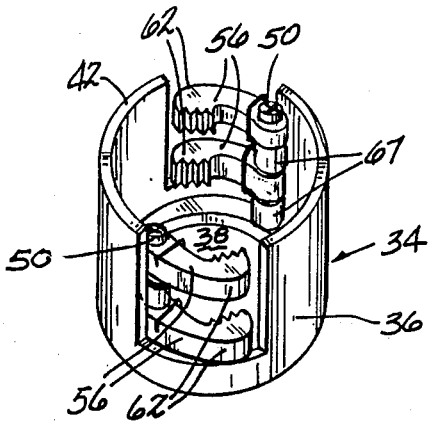
FIG. 2 is a perspective view of a sub-assembly of certain of the elements shown in FIG. 1.
Figure 3:
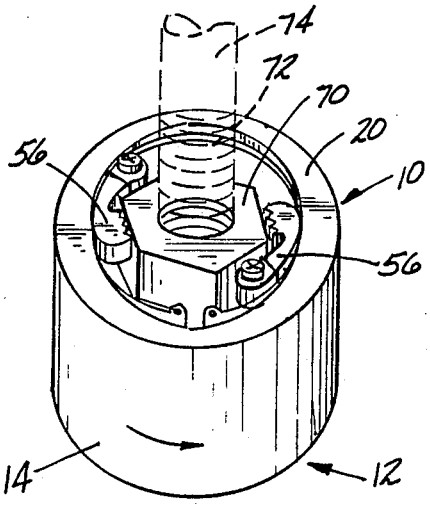
FIG. 3 is a perspective view of the preferred socket assembly in wrenching engagement with a nut which is shown in threaded engagement with an externally threaded member which is shown in phantom.
Figure 4:
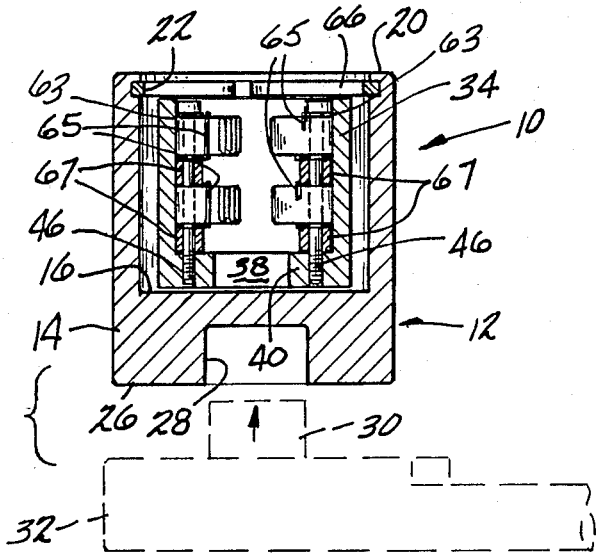
FIG. 4 is an axial sectional view of the preferred socket assembly showing in phantom a wrench positioned to enter into turning engagement with the socket assembly.

FIGS. 1, 3 and 4 show a preferred socket assembly 10 according to the invention. Assembly 10 comprises an outer annular member 12 having a base portion 14 with a floor 16 and an internal annular wall 18 upstanding from floor 16 and having cylindrical portions 19 defining an axis. Wall 18 terminates at an upper open end 20 and has an internal circumferential groove 22 just below end 20. Wall 18 also has a pair of diametrically opposite inwardly extending lobed cam surfaces 24 interrupting cylindrical wall portions 19. Cam surfaces 24 are identical and each has a clockwise facing component and a counterclockwise facing component. The clockwise and counterclockwise facing components are mirror images of each other and the junctures of the clockwise and counterclockwise facing components provide member 12 with a location of minimum internal transverse dimension. Finally, member 12 has a bottom end 26 parallel to floor 16 and containing an internal wrenching surface 28 shown about to be removably engaged by an external wrenching surface 30 of a wrench 32 which is shown in phantom in FIG. 4. To achieve such engagement, wrench 32 is moved in the direction of the arrow in FIG. 4 to insert wrenching surface 30 into wrenching surface 28 in known fashion.

Assembly 10 further comprises an inner annular member 34 having an outer cylindrical surface 36 defining an axis of member 34. Surface 36 is preferably but not necessarily of a diameter slightly less than the minimum internal transverse dimension of outer member 12, which, as aforesaid, is provided by the junctures of the clockwise and counterclockwise facing components of lobed cam surfaces 24. Inner member 34 has a central hole 38 at one end which also has an inturned base flange 40. Inner member 34 further has an end 42 opposite hole 38. A pair of like diametrically opposite parallel-sided slots 44 open at end 42. Slots 44 extend from end 42 substantially all the way to internal flange 40.

Base flange 40 is provided with a pair of diametrically spaced tapped holes 46 (FIGS. 1 and 4) parallel to the axis of inner member 34.

Socket assembly 10 further comprises a pair of like bolts 48 each having a head 50, a shank 52 and external threads 54 on shank 52 at the end thereof remote from head 50. Threads 54 mate with tapped holes 46 such that bolts 48 are capable of being turned into screw threaded engagement with holes 46.

Additionally, socket assembly 10 includes four like pawls 56 each being of more or less arcuate configuration, having a concave portion 58 and a serrated jaw portion 60 on its inner face and an outwardly bulged lobed portion 62 opposite concave portion 58. Each pawl 56 further has a mounting hole 64. Two pawls 56 are mounted on each bolt 48 with the shank 52 thereof passing through holes 64 and threads 54 of bolts 48 are brought into threaded engagement with tapped holes 46 and with outwardly bulged lobed portions 62 of pawls 56 located in slots 44. A spacer 63 is located directly under head 50 of each bolt 48, and each pawl 56 has a wire spring member 65 associated therewith resiliently urging jaw portion 60 outwardly away from the axis of annular member 34 in known fashion. Also, four sleeves 67 fit over shanks 52 for locating pawls 56 at the desired locations on bolts 48.

The two pawls 56 assembled with each bolt 48 include a lower pawl 56 and an upper pawl 56. The two lower pawls 56 are in registry with each other and the two upper pawls 56 are in registry with each other.

The assembly of inner annular member 34, bolts 48 and pawls 56 is a sub-assembly of socket assembly 10 and is assembled with outer annular member 12 within annular wall 18 and is retained therein by a split ring 66 which is commonly available as a Truarc TM ring which is placed in groove 22 of outer annular member 12.

Outwardly bulged lobed portions 62 of pawls 56 are engaged by internal wall 18, more particularly by lobed cam surfaces 24.

Relative rotation of outer annular member 12 with respect to inner annular member 34 will cause the counterclockwise facing components of cam surfaces 24 to move serrated jaw portions 60 of pawls 56 toward the axis of socket assembly 10, against the bias of springs 65.

More particularly, when a fastening device, such as a nut 70, having an across-the-flats dimension in the particular range adapted to be handled automatically by socket assembly 10 is placed in inner annular member 34 with opposite wrenching surfaces in engagement with serrated jaw portions 60 of one or both pairs of pawls 56 and with nut 70 in threaded engagement with an external thread 72 of a bolt 74, rotation of outer annular member 12 in the direction of arrow A in FIG. 3 will cause the counterclockwise facing components of cam surfaces 24 to push serrated jaw portions 60 of pawls 56 against the wrenching surfaces of nut 70 to effect wrenching rotation thereof in an advancing direction (if the threads are righthand threads).

Upon completion of the wrenching operation, which may involve applying socket assembly 10 to a bolt head instead of to a nut, assembly 10 is removed from the wrenching surfaces.

To perform a loosening operation, socket assembly 10 is manipulated so that bulged lobed portions 62 of pawls 56 engage the clockwise facing components of cam surfaces 24 instead of the counterclockwise facing components thereof, socket assembly 10 is applied to the external wrenching surfaces and clockwise torque is applied. This will cause loosening rotation of the fastening device in a fashion similar to the tightening operation described above.

A socket assembly 10 of: a first size can handle an across-the-flats wrenching dimension in the range from 0.125 inch to 0.375 inch; a second size can handle such a range from 0.375 inch to 0.75 inch; and a third size can handle such a range from 0.75 inch to 1.125 inches. Thus, the invention reduces from about sixteen or twenty to three the number of sockets or socket assemblies needed to cover the wrenching size range from 0.125 inch to 1.125 inches. Furthermore, the wrenching surfaces can be hexagonal or square and the distance across the flats can be expressed in British or Metric units.

Figure 5:
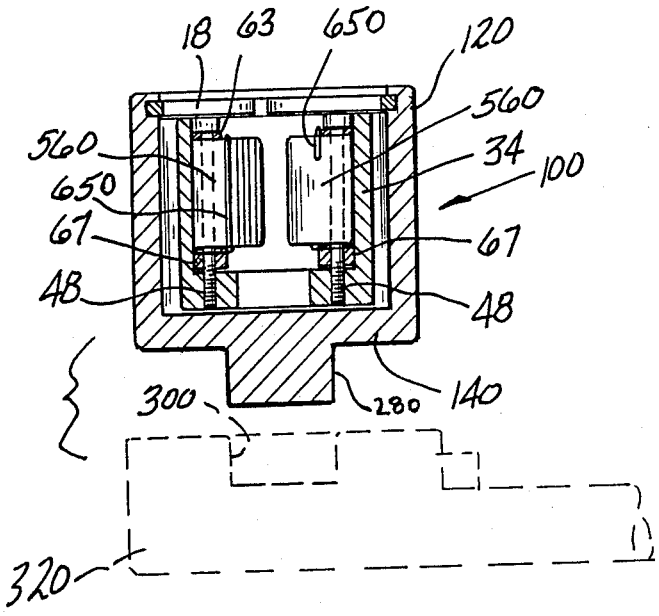
FIG. 5 is a view similar to FIG. 4 but showing a modified preferred socket assembly and in phantom an automatic lug wrench positioned to enter into turning engagement with the socket assembly.

FIG. 5 shows in axial section a modified preferred socket assembly 100 embodying the invention. Socket assembly 100 is particularly suitable for use with an automatic lug wrench 320 having an internal wrenching surface 300. Socket assembly 100 has an outer annular member 120 having a base portion 140 with an external wrenching surface 280 adapted for wrenching engagement with internal wrenching surface 300 of lug wrench 320. Socket assembly 100 is otherwise like socket assembly 10 except that socket assembly 100 has only one pawl 560, one wire spring member 650 and one spacer 67 associated with each bolt 48. Pawls 560 and spring members 650 are of increased axial length compared with pawls 56 and spring members 65.

It is apparent that the invention achieves the above stated objects and advantages and others.

The disclosed details are exemplary only and are not to be taken as limitations on the invention except as those details are included in the appended claims.

What is claimed is:

1. A socket assembly for imparting wrenching torque to wrenching surfaces having dimensions within a predetermined size range, said assembly comprising an outer annular member adapted for releasable engagement by a wrench and an internal annular wall having a pair of like cylindrical portions defining an assembly axis and a pair of diametrically opposite inwardly extending lobed cam surfaces joining said cylindrical portions, an inner annular member within said wall and having first and second diametrically opposite slots open at one end of said inner member, first and second identical pawls associated with said first and second slots, respectively, each said pawl having an inner face with a jaw portion and an outwardly bulged lobed portion opposite said inner face, said pawls mounted with said inner faces confronting each other and with said bulged lobed portion of each said pawl extending outwardly through its said associated slot, and means resiliently urging said bulged lobed portion of said first and second pawls outwardly against said cam surfaces, so that with said wrenching surfaces within said inner member, relative rotation of said members in one direction will cause said cam surfaces to push said jaw portions against the wrenching surfaces and said members will then rotate together to apply wrenching torque to said wrenching surfaces, wherein each said pawl has a mounting hole therethrough and said assembly further comprises first and second diametrically opposite cylindrical members parallel to and equidistant from said assembly axis, said first cylindrical member passing through said mounting hole of said first pawl and said second cylindrical member passing through said mounting hole of said second pawl.

2. The socket assembly according to claim 1 further comprising third and fourth pawls identical to said first and second pawls and spaced axially therefrom, said third and fourth pawls associated with said first and second slots, respectively, and the inner faces of said third and fourth pawls confronting each other, and said first cylindrical member passing through the mounting hole of said third pawl and said second cylindrical member passing through the mounting hole of said fourth pawl, said outwardly bulged lobed portion of said third pawl extending outwardly through said first slot and said outwardly bulged lobed portion of said fourth pawl extending outwardly through said second slot, and means resiliently urging said bulged lobed portions of said third and fourth pawls outwardly against said cam surfaces.

3. The socket assembly according to claim 2 wherein said resiliently urging means are wire spring members.

* * * * *